United States Patent [19]

Westendorf

[11] 4,051,962

[45] Oct. 4, 1977

[54] LOADER DEVICE FOR A TRACTOR

[76] Inventor: Neal W. Westendorf, Smithland, Iowa 51056

[21] Appl. No.: 761,322

[22] Filed: Jan. 21, 1977

[51] Int. Cl.[2] ..... E02F 3/62

[52] U.S. Cl. ..... 214/131 A; 172/275; 182/210; 280/460 R

[58] Field of Search ..... 214/131 A, 145 A; 172/272, 273, 274, 275; 56/15.6; 280/460 R, 460 A, 461 R, 461 A, 504, 508, 760; 182/209, 210; 294/83 R

[56] References Cited

U.S. PATENT DOCUMENTS

| | | | |
|---|---|---|---|
| 3,056,624 | 10/1962 | Nardone | 294/83 R |
| 3,324,954 | 6/1967 | Westendorf | 214/131 A X |
| 3,554,396 | 1/1971 | Demkiw | 214/131 A X |
| 3,610,450 | 10/1971 | Demkiw | 214/131 A X |

*Primary Examiner*—L. J. Paperner

*Attorney, Agent, or Firm*—Zarley, McKee, Thomte, Voorhees & Sease

[57] ABSTRACT

A loader device is described for use on a tractor which has a substantially horizontally disposed tubular member extending laterally from each side thereof adjacent the forward end thereof. The tractor is also provided with a connector element provided at each side thereof rearwardly of the forward end thereof. The loader device comprises a sub-frame having longitudinally extending side frame member. A boom structure is pivotally connected to a tower secured to the side frame members and has a material handling implement connected to the forward end thereof. Each of the side frame members has a forwardly extending slot formed therein adapted to receive the laterally extending tubular members therein at times. A lock element is pivotally secured to each of the side frame members and locks the tubular member in the slot when in its locked position.

2 Claims, 12 Drawing Figures

LOADER DEVICE FOR A TRACTOR

BACKGROUND OF THE INVENTION

This invention relates to a loader device for a tractor and more particularly to a novel means for locking the loader device on the tractor.

Many types of loader devices have been previously devised for mounting on tractors. One such type of loader is disclosed in U.S. Pat. No. 3,324,954. Although the loader device of the above-identified patent has met with considerable success, the instant invention relates to a more convenient means for securing the loader device to the tractor.

Therefore, it is a principal object of the invention to provide an improved loader device for a tractor.

A further object of the invention is to provide a loader device which is positively maintained on the tractor through a simple but yet efficient connection means.

A further object of the invention is to provide a loader device for a tractor including a lock means which is automatically re-set as the loader is being dismounted from the tractor.

A further object of the invention is to provide a loader device which is economical to manufacture, durable in use and refined in appearance.

SUMMARY OF THE INVENTION

Figure 1:
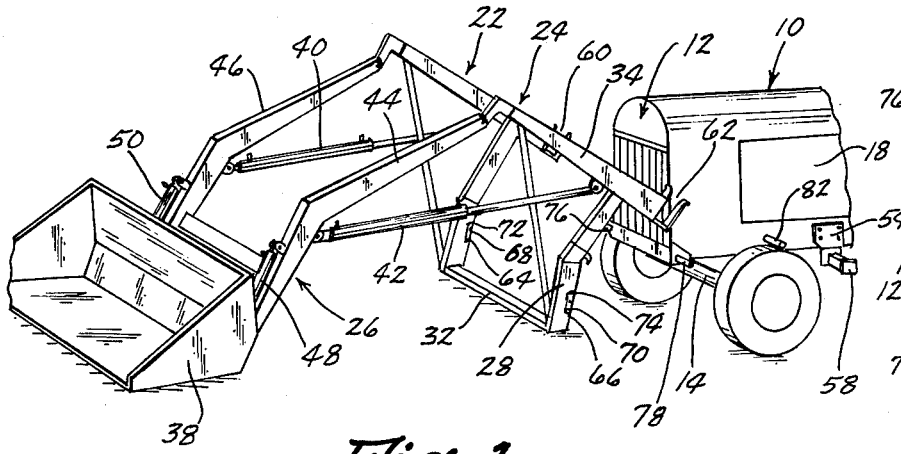
FIG. 1 is a front perspective view of the loader device of this invention.
Figure 2:
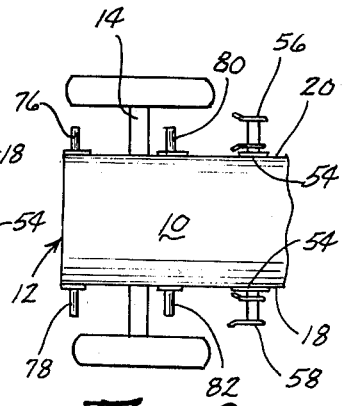
FIG. 2 is a partial top view of a tractor to which the loader device is mounted.
Figure 3:
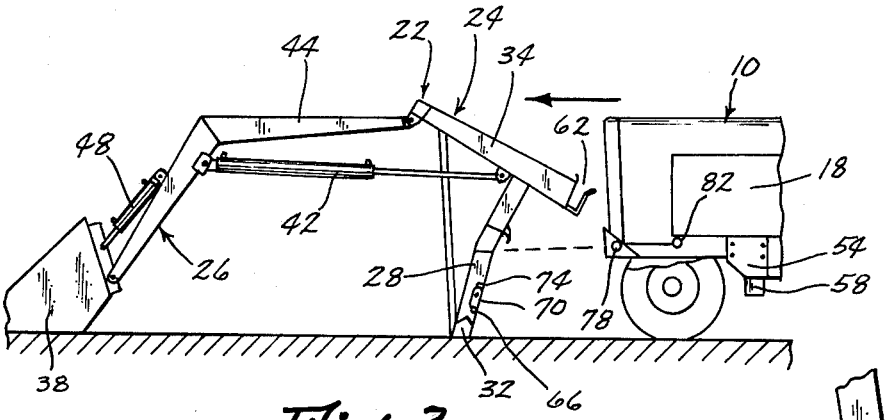
FIG. 3 is a side view of the device illustrating its relationship to a tractor.
Figure 4:
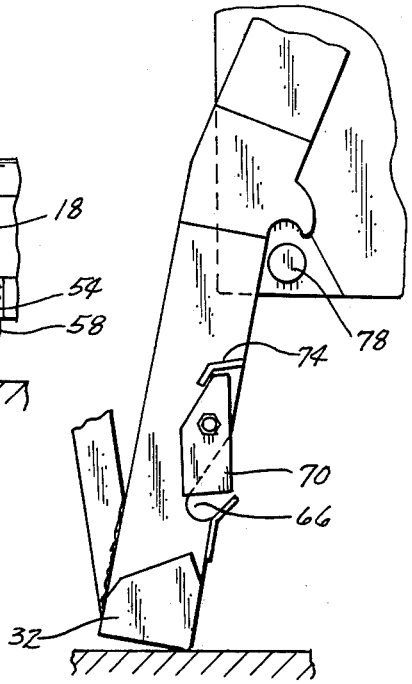
FIG. 4 is a partial side view illustrating the relationship of the tractor to the loader device during the initial cup mounting operation.
Figure 5:
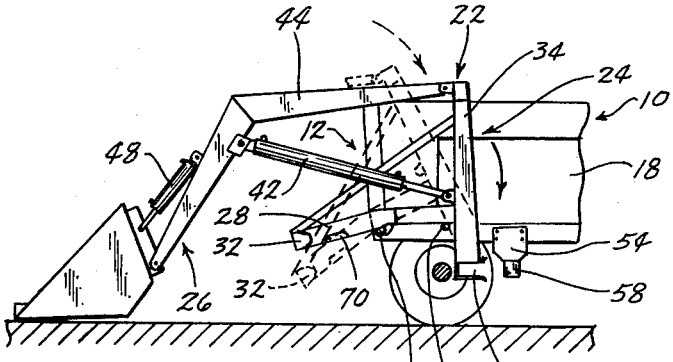
FIG. 5 is a view similar to FIG. 3 except that the loader is being illustrated as being mounted on the tractor.
Figure 6:
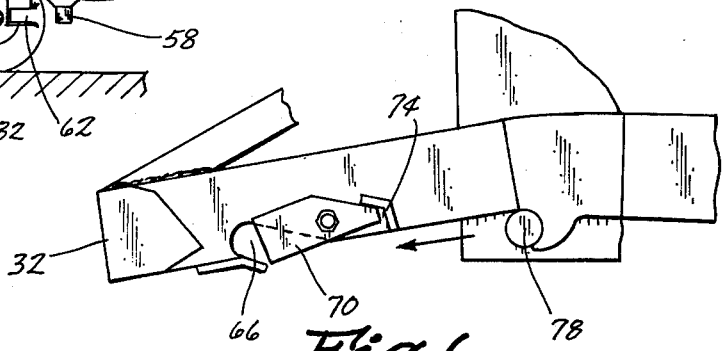
FIG. 6 is a view similar to FIG. 4 except that the components are shown in the relationship corresponding to FIG. 5.
Figure 7:
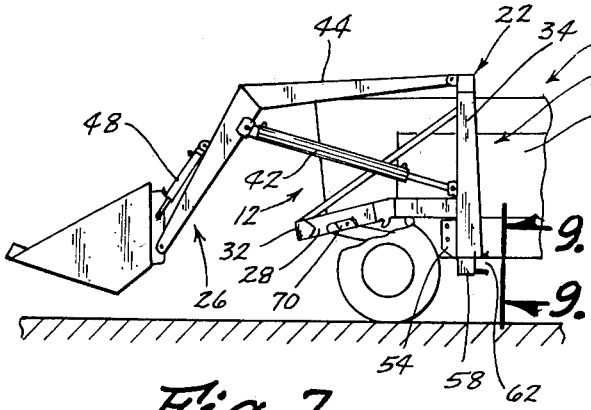
FIG. 7 is a view similar to FIGS. 3 and 5 except that the loader device is illustrated as being completely mounted on the tractor.
Figure 8:
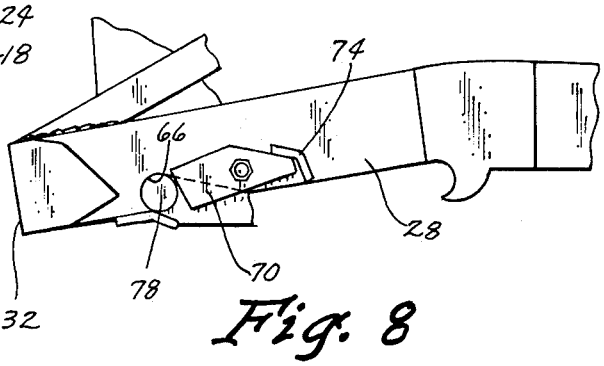
FIG. 8 is a view similar to FIGS. 4 and 6 but which corresponds to FIG. 7.
Figure 9:
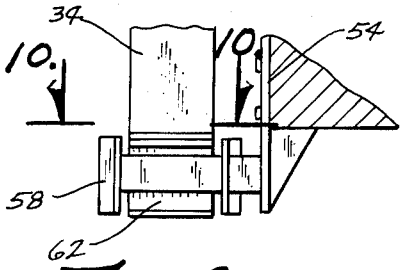
FIG. 9 is an enlarged sectional view seen on lines 9—9 of FIG. 7.
Figure 10:
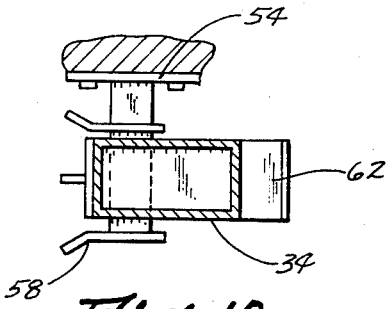
FIG. 10 is a sectional view seen on lines 10—10 of FIG. 9.

The invention relates to a loader device and more particularly to a loader device which may be mounted on the tractor through the use of the hydraulic cylinders normally provided with the loder. The tractor is driven adjacent the rearward end of the loader frame and the hydraulic hoses of the tractor hydraulic system are connected to the boom actuating hydraulic cylinders. Actuation of the hydraulic cylinders causes the subframe to pivot about the forward end of the tractor. The device includes means for automatically locking the loader device on the tractor when the loader device is completely mounted thereon. The locking device is automatically re-set as the loader device is being removed from the tractor.

DESCRIPTION OF THE PREFERRED EMBODIMENT

The numeral 10 generally designates a tractor having a forward end 12, front axle 14, rearward end 16 and opposite sides 18 and 20.

The numeral 22 refers generally to the loader device of this invention which is adapted to be mounted on the tractor 10. Loader 22 generally comprises a tower and sub-frame assembly 24 and boom means 26. Assembly 24 comprises a pair of longitudinally extending and spaced-apart side frame members 28 and 30 having rearward and forward ends. The forward ends of side frame members 28 and 30 are connected by a frame member 32. Towers 34 and 36 are secured to the rearward end of side frame members 28 and 30 respectively and extend upwardly therefrom. Boom 26 is pivotally connected at its rearward end to the upper ends of the towers 34 and 36 and is adapted to have a material handling implement 38 pivotally secured to the forward ends thereof. Hydraulic cylinders 40 and 42 are pivotally connected at one end thereof to the towers 34 and 36 respectively and pivotally connected at the other ends to the boom arms 44 and 46 respectively. Hydraulic cylinders 48 and 50 are provided for pivotally moving the implement 38 relative to the boom arms 44 and 46.

A pair of hanger brackets 52 and 54 are secured to the opposite sides of the tractor frame and have tubular members 56 and 58 secured thereto and extending laterally therefrom respectively. Each of the towers 34 and 36 are provided with a rearwardly extending channel means 60 and 62 respectively adapted to receive the tubes 56 and 58 respectively as illustrated in the drawings.

Side frame members 28 and 30 are provided with forwardly extending slots 64 and 66 formed therein adjacent the forward ends thereof which have open rearward ends as seen in the drawings. Locks 68 and 70 are pivotally connected intermediate the lengths thereof to the side frame members 28 and 30 adjacent slots 64 and 66. The locks 68 and 70 are pivotally movable between locking and non-locking positions. Brackets 72 and 74 are secured to side frame members 28 and 30 to limit the downward pivotal movement of the locks 68 and 70 and to maintain the same in the locked positions. Additionally, the brackets 72 and 74 serve to maintain the locks 68 and 70 in the non-locking positions as illustrated in the drawings. As seen in the drawings, the slots 64 and 66 are adapted to receive the tubular members 76 and 78 which are secured to the tractor adjacent the forward end thereof and which extend laterally from opposite sides thereof. The exact position of the tubular members 76 and 78 and the mounting thereof will vary from tractor to tractor. In some cases, the tubular members 78 and 78 will be positioned forwardly of the tractor and in other cases will be positioned below the forward end of the tractor. Tractor 10 is also provided with a pair of laterally extending rollers 80 and 82 which extend outwardly from opposite sides thereof to assist in the smooth mounting of the loader device on the tractor.

FIG. 1 illustrates the loader device in a dismounted condition. In the position of FIG. 1, the forward end of side frame members 28 and 30 are in ground engagement and extend upwardly and rearwardly therefrom. When it is desired to mount the loader on the tractor, the tractor is maneuvered so that the forward end thereof is received between the side frame members 28 and 30. The hydraulic hoses from the tractor hydraulic system are then connected to the hydraulic cylinders 40 and 42. Retraction of the cylinder rods within the hydraulic cylinders 40 and 42 causes the tower and sub-frame assembly 24 to be pivoted relative to the tractor about tubular members 76 and 78. The side frame members 28 and 30 are pivotally moved relative to the tractor until the side frame members 28 and 30 engage the rollers 80 and 82 and until the side frame members are substantially horizontally disposed. The tractor is then driven forwardly relative to the loader so that tubes 56 and 58 are received within the channels 60 and 62 and so that the tubular members 76 and 78 are received by the slots 64 and 66 respectively. As the tubular members 76 and 78 move forwardly within their respective slots, they will engage the locks 68 and 70 and will cause the same to pivotally move upwardly until the tubular members 76 and 78 are positioned forwardly thereof with the result being that the locks 68 and 70 automatically return to the locking position. As seen in the drawings, with the locks 68 and 70 in the locking position, the forward ends thereof are positioned rearwardly of the tubular members 76 and 78 to positively maintain the tubular members 76 and 78 within the slots 64 and 66.

Figure 11:
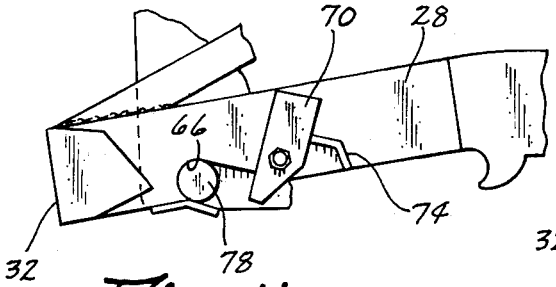
FIG. 11 is a view similar to FIGS. 4, 6 and 8 except that the locking lever is illustrated in its unlocked position for removing the loader device from a tractor.
Figure 12:
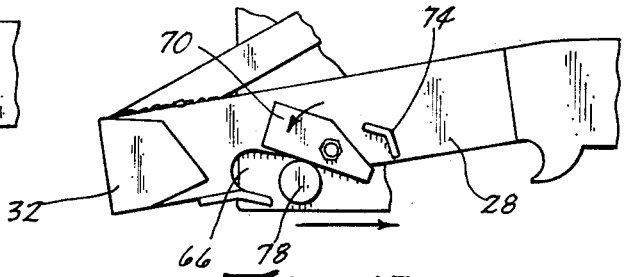
FIG. 12 is a view similar to FIG. 11 but which illustrates the locking lever being repositioned as the loader device is being removed from the tractor.

When it is desired to unload or dismount the loader from the tractor, the operator simply pivotally moves the lock 68 and 70 from the locked position to the unlocked position as seen in FIG. 11. The tractor operator positions the material handling implement 38 on the ground and drives the tractor rearwardly with respect to the loader device. As the tractor moves rearwrdly with respect to the loader device, the tubular members 76 and 78 move rearwardly within the slots 64 and 66 until they engage the lower ends of the locks 68 and 70. Continued rearward movement of the tubular members 76 and 78 relative to the slots 64 and 66 and the locks 68 and 70 causes the locks 68 and 70 to be automatically returned to the locking position but such return is achieved only after the tubular members 76 and 78 have moved sufficiently rearwardly within the slots 64 and 66 so that they will be positioned rearwardly of the forward ends of the locks 68 and 70 as illustrated in FIG. 12. The tractor operator would continue to move the tractor rearwardly relative to the loader and would operate the hydraulic cylinders 40 and 42 to pivotally move the sub-frame and tower assembly 24 so that the forward end of the sub-frame 24 was positioned on the ground. The tractor operator would then disconnect the hydraulic hoses and back the tractor from the loader.

Thus it can be seen that a novel locking means has been provided for mounting a loader device on a tractor which positively maintains the loader device on the tractor during periods of use. It can also be seen that the automatic locking of the locks 68 and 70 is a desirable feature since the tractor operator does not have to physically lock the same into position once the loader has been mounted on the tractor. The fact that the locks 68 and 70 are automatically returned to the locking position as the loader is being removed from the tractor is also desirable since it is not necessary for the tractor operator to physically position the same.

It can therefore be seen that the invention accomplishes at least all of its stated objectives.

I claim:

1. In combination, a tractor having rearward and forward ends and opposite sides, a substantially horizontally disposed tubular member operatively secured to said tractor and extending laterally from each side of the tractor adjacent the forward end thereof, connector means secured to said tractor at each side thereof rearwardly of the forward end thereof, a loader device comprising a sub-frame means having spaced-apart and longitudinally extending side frame members having rearward and forward ends; a tower member operatively secured to each of said side frame members and extending upwardly therefrom; a boom means having rearward and forward ends and being pivotally secured at its rearward end to said tower members and being adapted to have a material handling implement connected to the forward end thereof; each of said side frame members having a forwardly extending slot formed therein having an open rearward end adapted to receive the laterally extending tubular members therein at times; said side frame members beng operatively connected to said connector means, a lock means pivotally secured to each of said side frame members and having first and second ends; each of said lock means being pivotally movable between first and second positions; said lock means, when in its first position, having one end thereof positioned rearwardly of the tubular member received in said slot so as to maintain said side frame member on said tubular member; each of said lock means being pivotally movable to said second position wherein the other end of said lock means is in communication with said slot spaced rearwardly from said tubular member so that said tubular member may move rearwardly in said slot to enable the loader device to be removed from the tractor and wherein the said rearward movement of said tubular member will cause said lock means to pivotally move from its said second position to its said first position for facilitating subsequent re-mounting of the loader on the tractor.

2. The combination of claim 1 wherein a stop means is provided on each of said side frame members rearwardly of said slot for positioning said lock means in its said first and second positions.

* * * * *